United States Patent [19]

McKenzie et al.

[11] 4,258,797

[45] Mar. 31, 1981

[54] SCRAPER BLADE UNDERCARRIAGE MOUNTING ASSEMBLY

[76] Inventors: Neil D. McKenzie, R.R. #2, St. Croix Falls, Wis. 54024; Leo R. Tift, 371 Whitmore Rd., Hastings, Mich. 49058

[21] Appl. No.: 892,641

[22] Filed: Apr. 3, 1978

[51] Int. Cl.[3] ..... E02F 3/76

[52] U.S. Cl. ..... 172/796; 37/42 VL

[58] Field of Search ..... 172/297, 305, 308, 446, 172/447, 476, 477, 741, 742, 781, 788, 791, 792, 793, 795, 796, 797, 739, ; 37/42 R, 42 VL

[56] References Cited

U.S. PATENT DOCUMENTS

| | | | |
|---|---|---|---|
| 160,535 | 3/1875 | McCall et al. | 172/788 |
| 1,193,,67 | 8/1916 | Martin | 172/797 |
| 1,760,926 | 6/1930 | Weeks | 172/795 X |
| 1,793,066 | 2/1931 | Dean | 172/795 |
| 1,878,080 | 9/1932 | Weeks | 172/795 X |
| 1,932,601 | 10/1933 | Price | 172/795 X |
| 1,966,936 | 7/1934 | Schermerhorn | 172/795 X |
| 2,238,389 | 4/1941 | Kerber | 172/788 |
| 2,601,380 | 6/1952 | Flory | 172/742 X |
| 2,749,631 | 6/1956 | Thompson | 172/447 X |
| 3,007,266 | 11/1961 | Brand | 172/788 |
| 3,086,303 | 4/1963 | Weeks | 37/42 VL |
| 3,234,669 | 2/1966 | Kachnik et al. | 172/739 X |
| 3,355,825 | 12/1967 | Weeks | 37/42 R |
| 3,444,936 | 5/1969 | Page et al. | 172/795 |
| 3,517,753 | 6/1970 | Tift | 172/795 |
| 4,161,987 | 7/1979 | Tolmer | 172/791 |

*Primary Examiner*—Richard T. Stouffer

*Attorney, Agent, or Firm*—Dorsey, Windhorst, Hannaford, Whitney & Halladay

[57] ABSTRACT

A scraper blade supporting and positioning assembly is used for mounting a scraper blade on a vehicle having an undercarriage frame and a longitudinal axis corresponding to its direction of travel. The assembly comprises a scraper blade and first and second mounting subassemblies. The first mounting subassembly is pivotally connected to the undercarriage frame and includes a hydraulic cylinder for moving and positioning itself about a first pivot axis defined by the pivotal connection to the undercarriage frame. The first pivot axis is oriented substantially parallel to the plane of the undercarriage frame and substantially perpendicular to the longitudinal axis of the vehicle. The second mounting subassembly is rigidly connected to the first mounting subassembly and pivotally connected to the scraper blade. The second mounting subassembly includes a hydraulic cylinder for moving and positioning the scraper blade about a second pivot axis which is defined by the pivotal connection between the scraper blade and the second subassembly. The second pivot axis is substantially parallel to a plane which is perpendicular to the first pivot axis. Pivotal movement of the first subassembly around the first pivot axis causes the second pivot axis to be rotated in a plane substantially perpendicular to the first pivot axis.

10 Claims, 5 Drawing Figures

SCRAPER BLADE UNDERCARRIAGE MOUNTING ASSEMBLY

BACKGROUND OF THE INVENTION

1. Field of the Invention

The present invention relates to an assembly for mounting a scraper blade beneath the undercarriage frame of a vehicle, and more particularly, to a mounting assembly structure which supports and permits adjustable positioning of the scraper blade in a variety of different positions relative to the surface to be scraped.

2. Description of the Prior Art

There are a variety of known arrangements for mounting a scraper blade to the underbody of a vehicle. Their mechanisms vary widely in structure and also in the way in which the scraper blade can be adjusted and positioned so as to perform the scraping task. In the more basic arrangements, the scraper blade is limited by its mounting structure to certain modes of movement. Typically, the scraper blade can be rotated around an axis which is vertical to the vehicle frame, thereby permitting the scraped material to be displaced to either side of the vehicle. Such arrangements also typically permit the blade to be rotated around a horizontal axis passing through the upper edge of the blade, whereby the lower edge of the blade can be rotated into or out of contact with the surface to be scraped. In another variation of this basic underbody mounting arrangement, the blade or the blade and its mounting assembly can be moved up and down in the direction of the vertical rotational axis. Examples of mechanisms of these general types appear in the following U.S. Pats.: E. Weeks, No. 1,760,926; E. Weeks, No. 1,878,080; Price, No. 1,932,601; Schermerhorn, No. 1,966,936; Tift, No. 3,517,753; W. Weeks, No. 3,355,825; and Dean, No. 1,793,066.

The basic scraper blade mounting assembly described in the preceding paragraph appears in other prior art embodiments with additional structure designed to introduce additional degrees of freedom of movement of the blade. These additional degrees of freedom are usually obtained by introducing structures which increase the number of axes of rotation for the blade or by adding means for translating the blade in the direction of one or more axes of rotation. The additional degrees of freedom can make the blade more flexible for handling different scraping tasks. For example, by permitting the blade to be angled relative to the horizontal plane of the vehicle frame, a "cornering" effect is developed which permits greater scraping effect to be concentrated at certain areas of the blade. This is particularly useful for scraping surfaces which are curved or otherwise nonplanar and for surfaces in which the material to be scraped is of nonuniform consistency, necessitating greater scraping force in some areas than in others. One known underbody scraper blade mounting assembly designed to accomplish this is disclosed in U.S. Pat. No. 2,238,389 to Kerber. A second such mounting structure developed for use with a grader machine rather than for undervehicle mounting is shown in U.S. Pat. No. 3,444,936 to Page, et al.

As can be noted from the disclosures of the Kerber and Page patents, prior art structures which introduce the additional degrees of freedom of movement necessary to perform cornering are complex. In addition, they may not be suitable for undercarriage frame mounting. Because of the complexity of the mechanical structures of these prior art structures, both the original and maintenance cost of scraper blade mounting assemblies of this design can be high. Moreover, it is obviously desirable to avoid the necessity of a special grader machine for such scraping tasks, because such devices cannot easily be equipped to carry a large load of sand or other material which, in snow scraping applications, may be spread on the scraped surface simultaneously with scraping.

SUMMARY OF THE INVENTION

The present invention involves an improved scraper blade mounting assembly which overcomes many disadvantages of the abovedescribed prior art structures. In particular, by mounting a scraper blade so that it can be rotated around two pivot axes, with each axis being oriented perpendicular to the plane of the other axis, and by linking the axes such that rotation of the blade mounting structure around one axis moves not only the blade but the orientation of the other pivot axis, a simple, yet flexible mounting structure is obtained. In accordance with the present invention, a scraper blade supporting and positioning assembly for use with a scraper blade and a vehicle having an undercarriage frame and a longitudinal axis corresponding to the direction of travel of the vehicle, comprises: first mounting means pivotally connected to said undercarriage frame and including means for moving and positioning said first mounting means about a first pivot axis defined by the pivotal connection to the undercarriage frame, said first pivot axis being oriented substantially parallel to the plane of the undercarriage frame and substantially perpendicular to the longitudinal axis of the vehicle; and second mounting means rigidly connected to said first mounting means and pivotally connected to the scraper blade, said second mounting means including means for moving and positioning the scraper blade about a second pivot axis defined by the pivotal connection between the scraper blade and the second mounting means, said second pivot axis being substantially parallel to a plane perpendicular to the first pivot axis, whereby pivotal movement of the first mounting means around the first pivot axis causes the second pivot axis to be rotated in a plane substantially perpendicular to the first pivot axis.

It is an object of the present invention to provide a scraper blade supporting and positioning assembly for use with a vehicle having an undercarriage frame.

It is a further object of the present invention to provide an underbody scraper blade supporting and positioning assembly which permits the scraper blade to be adjustably pivoted and positioned about a movable axis with a substantially vertical "home" position, which axis is adjustably pivotable and positionable about another axis which is substantially horizontal and perpendicular to the direction of travel of the vehicle.

It is a further object of the present invention to provide a scraper blade supporting and positioning assembly for a vehicle having an undercarriage frame and being pivotable and positionable as previously described with a mechanism which is relatively simple and economical, both as to original and maintenance costs.

These and other objects of the invention will become apparent from a study of the following description of the preferred embodiment, including the accompanying figures.

DETAILED DESCRIPTION OF THE PREFERRED EMBODIMENT

Figure 1:
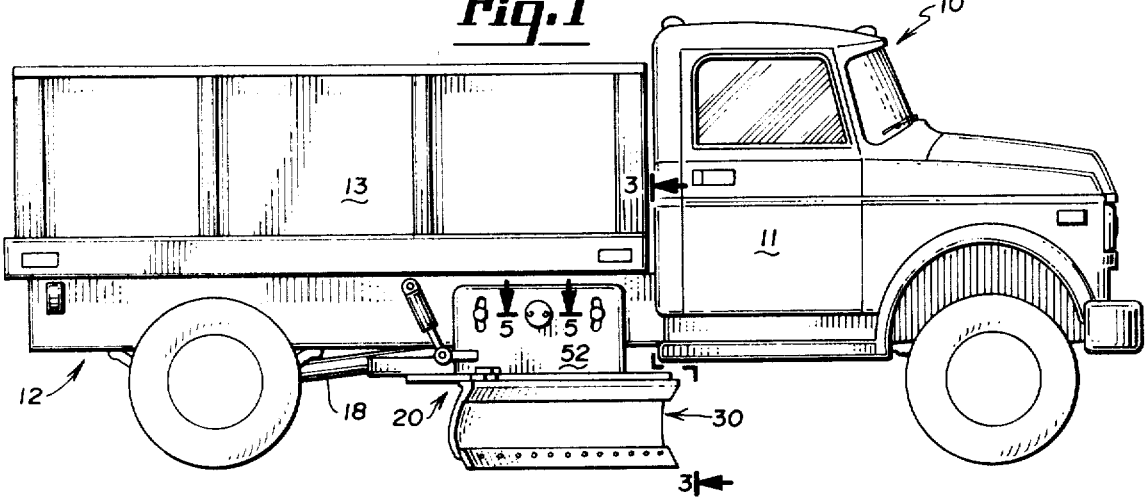
FIG. 1 is a side elevation of a vehicle showing the invention connected to the vehicle undercarriage.
Figure 2:
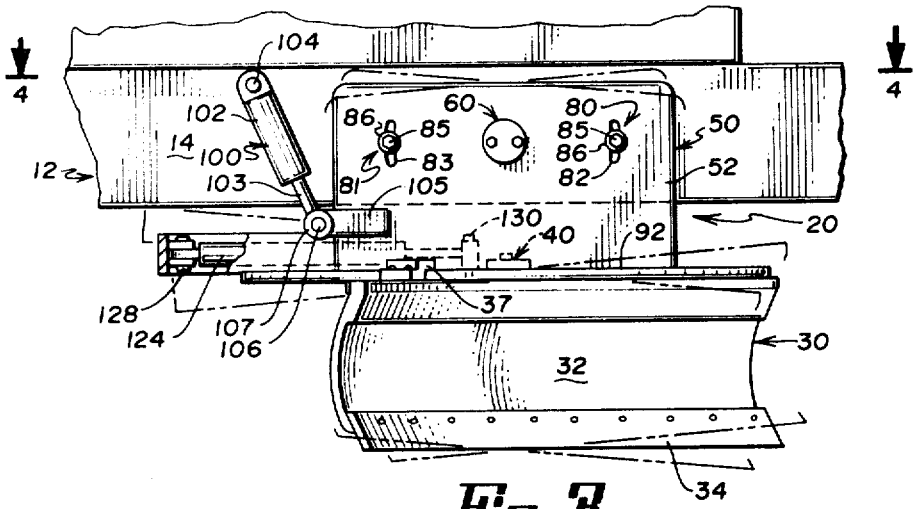
FIG. 2 is an enlarged, partial side elevation of the invention shown in FIG. 1.
Figure 4:
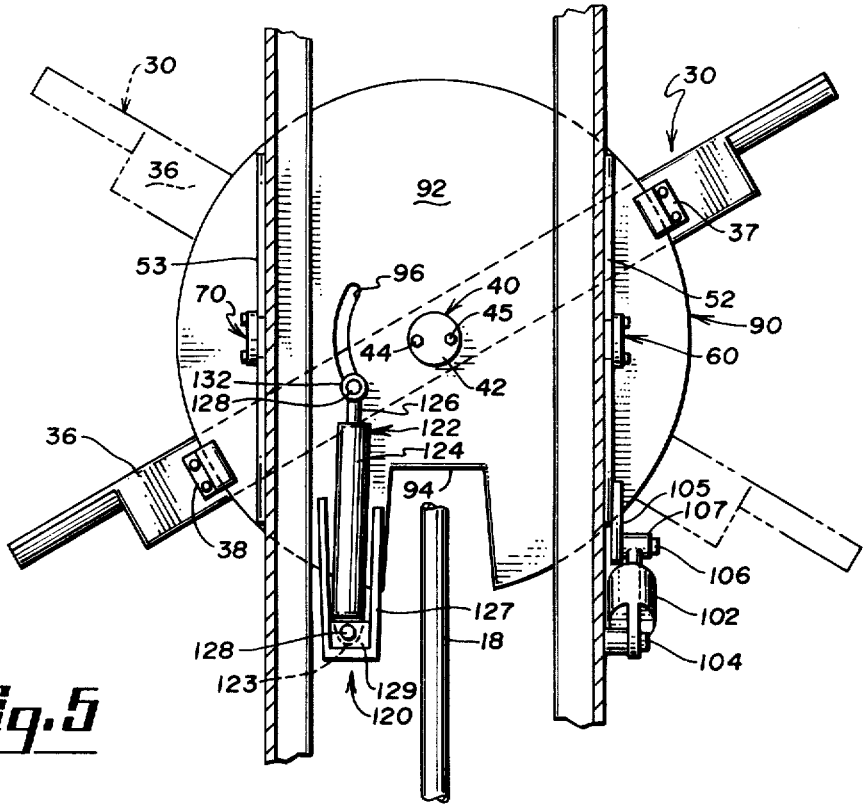
FIG. 4 is a sectional plan view taken along the line 4—4 in FIG. 2.

Referring now to FIG. 1, a vehicle 10 is shown which has a cab 11 and an enclosed bed area 13. An undercarriage frame 12 is located beneath the enclosed bed area 13 behind the cab 11. Referring now also to FIGS. 2 and 4, it is seen that the invention comprises a scraper blade supporting and positioning assembly 20 which is attached to the vehicle undercarriage frame 12 between the front and the rear wheels of the vehicle 10.

The preferred embodiment of the invention can conveniently be described by referring to three component assemblies: a pivoting box assembly 50, which straddles the undercarriage frame 12; a turntable mounting assembly 90, which is attached to the underside of the pivoting box assembly 50; and a scraper blade assembly 30, which is attached to the turntable mounting assembly 90. The structure of each of these assemblies and the coordination between them which produces the desired objectives of the invention will be described in greater detail in the following.

Figure 3:
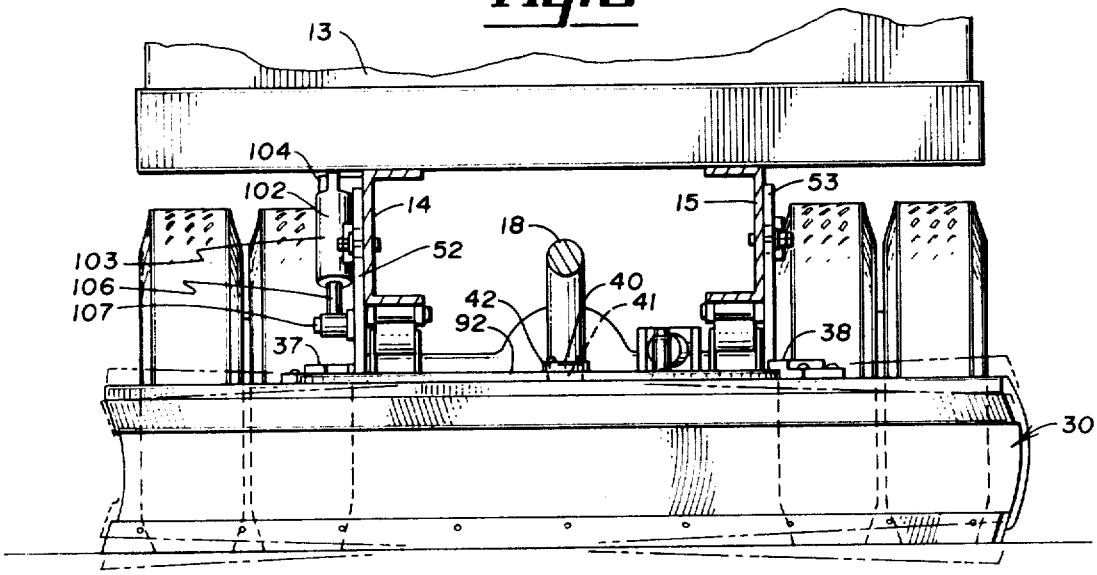
FIG. 3 is a sectional elevation taken along line 3—3 of FIG. 1.

The pivoting box assembly 50 comprises a pair of rigid, symmetrical, substantially rectangular plates 52, 53, one on either side of the undercarriage frame 12. The frame 12 is a planar structure which lies horizontal when the vehicle is on level ground. As best seen in FIGS. 3 and 4, each of these plates 52, 53 is pivotally mounted to one of the channel members 14, 15 which extend longitudinally in the direction of travel of the vehicle 10 and form a part of the vehicle undercarriage frame 12. Each of these plates 52, 53 is mounted such that it lies substantially parallel to, and in close proximity to, the large, planar, central web of one of the channels 14, 15.

Figure 5:
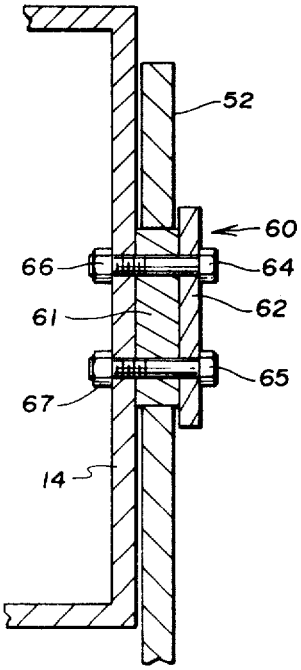
FIG. 5 is an enlarged sectional view of a pivot assembly typical of those used in the invention taken along the line 5—5 of FIG. 1.

The pivotal mounting of each of the two side plates 52, 53 is accomplished by means of a pair of symmetrical horizontal pivot assemblies 60, 70 one associated with each of the side plates 52, 53. As best seen in the detailed view of FIG. 5 showing the right side pivot assembly 60 (the left side assembly is identical in structure but 180 degrees different in orientation), the horizontal pivot assembly 60 comprises: a short, cylindrical segment 61 of a round rod, in the preferred embodiment having an outside diameter of approximately five inches; a circular cap plate 62, having in the preferred embodiment a diameter of approximately six inches; and a pair of cap screws 64, 65 with accompanying nuts 66, 67. The horizontal pivot assembly 60 is constructed as appears in FIG. 5, with the cap screws 64, 65 passing through a pair of symmetrical holes in the cap plate 62, and thence through holes in the cylindrical rod segment 61 and through holes in the center web of the undercarriage frame channel member 14 to receive nuts 66 and 67. The symmetrical holes in the cap plate 62 are set at a given distance apart such that the shafts of the cap screws 64, 65 align properly with the holes in the rod segment 61 and permit little or no movement of the rod segment 61 from side to side. Alternatively, the cap plate 62 can be welded to the rod segment 62, making it less necessary to depend on the cap screws 64, 65 to hold the rod segment 62 in position.

Each pivot assembly 60, 70 passes through a circular hole in its associated side plate 52, 53, respectively, with the hole in each side plate 52, 53 being somewhat larger than the outside diameter of the cylindrical tube segment 61 so as to permit free rotational movement of the side plates 52, 53 around their respective pivot assemblies 60, 70. The pivot assemblies 60, 70 are axially aligned and define a first pivot axis through their centers which is substantially parallel to the plane of the vehicle undercarriage frame 12 and substantially perpendicular to the direction of travel of the vehicle 10.

As best seen in FIG. 2, the pivotal movement of each of the side plates 52, 53 around its associated pivot assembly 60, 70, respectively, is guided and limited by a pair of guide bolt assemblies associated with each side plate. Using the side plate 52 on the righthand side of the vehicle 10 as an example (the structure on the lefthand side being symmetrical), each of the two guide bolt assemblies 80, 81 passes through one of a pair of arcuate slots 82, 83 in the side plate 52 and is fastened to the undercarriage frame channel member 14 adjacent the side plate 52. The length and curvature of the arcuate slots 82, 83 (and of the corresponding slots associated with the plate 53) are chosen such that the pivoting box assembly 50 can pivot freely around the pivot assemblies 60, 70 but is limited in the extent to which it can rotate. In the preferred embodiment, the permitted arc of rotation is approximately fifteen degrees. Each of the guide bolt assemblies 80, 81 includes, in addition to a cap screw 85 and nut (not shown), a washer 86 and a suitable bushing (not shown) surrounding the cap screw 85 to reduce friction when the pivoting box assembly 50 is moved.

Motive power for rotation of the pivoting box assembly 50 and static force for holding it in a particular position is provided by a conventional hydraulic system including a cylinder 100 mounted on one side of the undercarriage frame 12. In the preferred embodiment, the cylinder 100 is mounted on the right-hand side of the frame 12, but it could equally well be mounted on the other side or somewhere in the middle. As best seen in FIGS. 1, 2 and 4, the cylinder body end 102 of the hydraulic cylinder 100 is pivotally attached by a bolt and sleeve arrangement 104 or other suitable means to the adjacent undercarriage frame channel member 14. The piston rod end 103 of the hydraulic cylinder 100 is connected to the adjacent side plate 52 by means of a small mounting plate 105 affixed to the side plate 52, to which is connected a pin 106 projecting substantially vertically from the plane of the mounting plate 105 and the side plate 52. A sleeve 107 affixed to the piston rod end 103 which passes snugly over the pin 106 and is rotatably fastened thereon by any suitable means (not shown), completes the connection. With this structure both the cylinder body end 102 and the piston rod end 103 can pivot around their respective attachment points as needed when the cylinder 100 extends and retracts.

Connected to the lower edges of the pivoting box assembly 50 is the turntable assembly 90. This assembly consists of a substantially circular planar member, in the preferred embodiment a metal plate, 92 which is rigidly attached to the lower edges of the side plates 52, 53 of the pivoting box assembly 50 by any suitable means, as for example, by welds or bolted angle pieces (not shown). In the preferred embodiment, the circular plate 92 is interrupted by a large notch 94 in that portion of the circular plate 92 which is nearest the rear axle of the vehicle 10. This notch 94 permits the drive shaft 18 to pass over the circular plate 92 at a downward angle toward the rear axle without inteference with the plate 92. The circular plate 92 also includes an arcuate guide slot 96 which is coordinated with a blade rotating assembly 120 which will be discussed in greater detail below in connection with the description of the connection of the scraper blade assembly 30 to the turntable assembly 90.

The scraper blade assembly 30, as best seen in FIGS. 2 and 4, comprises, in the preferred embodiment, a curved plate of thick metal forming the main body 32 of the blade assembly 30 with a scraping edge 34 along its lower edge. In the preferred embodiment, this scraping edge 34 is affixed to the blade main body 32 by bolts or other suitable nonpermanent means so that it may be replaced as necessary for wear. Connected to the top edge of the blade main body 32 is a long, narrow blade mounting plate 36, the upper surface of which is adjacent to and lies flat against the lower side of the circular plate 92 of the turntable assembly 90. Connecting the blade mounting plate 36 to the circular plate 92 of the turntable assembly 90 is a pair of roughly z-shaped mounting clips 37, 38. One leg of each of these clips 37, 38 is connected to the upper surface of the blade mounting plate 36 and the other edge is hooked over the circular outer edge of the circular plate 92 of the turntable assembly 90.

Also serving to connect the blade mounting plate 36 to the circular plate 92 is a vertical pivot assembly 40 passing through the center of the circular plate 92 of the turntable assembly 90. The vertical pivot assembly 40 is attached to the blade mounting plate 36 midway between the pair of mounting clips 37, 38 on the top of the blade mounting plate 36. The vertical pivot assembly 40 is of the same construction as the pair of horizontal pivot assemblies 60, 70 used to mount the pivoting box assembly 50, and differs only in orientation. In the case of the vertical pivot assembly 40, the cap plate 42 is horizontal and is located above the circular plate 92, with the cap screws 44, 45 passing down through the cylinder segment 41 and the blade mounting plate 36. Nuts (not shown) associated with the cap screws 44, 45 complete the assembly. As a result of this arrangement, a portion of the weight of the scraper blade assembly 30 is carried by each of three points: the pair of mounting clips 37, 38 which slide on the upper surface of the circular plate 92 and the vertical pivot assembly 40, the cap plate 42 of which also slides on the upper surface of the circular plate 92. Suitable lubrication is, of course, required for each of these sliding, weight-bearing points. Due to this structure, the scraper blade assembly 30 is free to rotate about a second pivot axis, which passes through the center of the vertical pivot assembly 40 and which is substantially vertical to the circular plate 92, through an arc of approximately ninety degrees, so that the blade assembly 30 can be used to displace material to either side of the direction of travel of the vehicle 10. A larger arc of rotation can be obtained if desired by ensuring that the clips 37, 38 do not interfere with the lower corners of the side plates 52, 53 when blade rotation brings the clips 37, 38 under the channel members 14, 16.

As best seen in FIGS. 2 and 4, providing the motive power for movement of the scraper blade assembly 30 around the second pivot axis and the static force for holding it in a particular angular position is the previously mentioned blade rotating assembly 120, comprising a conventional hydraulic system, including a cylinder 122 having its cylinder body end 124 connected with a point fixed relative to the circular plate 92 while its piston rod end 126 is connected with the blade mounting plate 36. In the preferred embodiment, connection of the cylinder body end 124 of the hydraulic piston 122 is accomplished by a sling arrangement 127. shaped roughly like a three-sided, diverging trough, which is affixed to the upper side of the circular plate 92. The clevis 123 at the end of the cylinder body 124 is pivotally attached to the sling 127 by any suitable means, as by a pin 128 passing through a plate 129 located at the rearmost portion of the sling 127. The piston rod end 126 of the cylinder 122 is pivotally attached to the blade mounting plate 36 by means of a pin 130 extending substantially vertically from the upper surface of the blade mounting plate 36 through the arcuate guide slot 96 and a sleeve 132 affixed to the piston end 126. This forms a pivotal point of attachment as described in connection with the hydraulic cylinder 100 which powers movement of the pivoting box assembly 50.

In operation, the blade supporting and positioning assembly of the present invention permits the scraper blade assembly 30 to adjust to a variety of positions. First, adjustment of the scraper blade assembly 30 using the two pivot axes independently can be considered. By rotating the pivoting box assembly 50 on its paired horizontal pivot assemblies 60, 70 (defining the first pivot axis) the blade assembly 30 can be raised and lowered relative to the surface to be scraped. The blade assembly 30 can also be rotated on the vertical pivot assembly 40 connected to the turntable assembly 90 (defining the second pivot axis). This latter mode of rotation permits the blade assembly 30 to direct scraped material to either side of the direction of travel of the vehicle. The combined use of movement around the first and second axes allows the blade assembly 30 to be positioned in other ways. In particular, rotation of the pivoting box assembly 50 around the first pivot axis can be used to tilt the second pivot axis in either direction from a "home" position in which the second pivot axis is substantially vertical. This tilting of the second pivot axis permits the invention to achieve a "cornering" effect, by which the lower edge of the scraping edge 34 is tilted, as shown in FIGS. 2 and 3, so that it lies in a plane which is not parallel to the plane of the undercarriage frame 12. To do this the scraper blade assembly 30 is rotated around the second pivot axis so that the lower edge of the scraping edge 34 is not parallel to the first pivot axis. When the pivoting box assembly is rotated around the first pivot axis with the scraper blade assembly 30 in such a position, one end of the scraping edge 34 is raised from the surface to be scraped while the other end is lowered toward or against the surface to be scraped. The end which is raised (or lowered) depends on the rotational position of the scraping edge 34 relative to the first pivot axis and also on the direction in which the second pivot axis is tilted. Accordingly, by selecting the angular position of the pivoting box assembly 50 around the first pivot axis and the angular position of the scraper blade assembly 30 around the second pivot axis the appropriate position of the scraper blade assembly 30 relative to the surface to be scraped can be selected, including "cornering."

It will be apparent to those skilled in the art that the present invention is not limited to the specific structure shown in the drawings. For example, means for motive power other than hydraulic cylinders 100, 122 could be used and the circular plate 92 forming the turntable assembly 90 could be replaced by a pair of arcuate members, one mounted on either side of the pivoting box 50, and a crossbar for mounting the vertical pivot assembly 40. Moreover, the pivoting box assembly 50 could be replaced by a variety of other pivoting structures which afford the same opportunity for pivotal connection to the undercarriage frame 12 and rigid connection to the turntable assembly 90. Accordingly, although one specific embodiment of the present invention has been shown and described, those skilled in the art will perceive further modifications, other than those specifically pointed out above, which can be made without departing from the spirit of the invention, and it is intended by the appended claims to cover all such modifications as fall within the true spirit and scope of the invention.

We claim:

1. A scraper blade supporting and positioning assembly for mounting a scraper blade under a vehicle, said vehicle having an undercarriage frame and a longitudinal axis corresponding to the direction of travel of the vehicle, comprising:

a scraper blade;

first mounting means pivotally connectable to said undercarriage frame and when so connected to said frame having a home position which would correspond to the lower edge of the scraper blade being substantially parallel to the plane of the undercarriage frame regardless of the angle between said blade and said longitudinal axis, said first mounting means comprising a pair of rigid, planar members, said planar members being substantially parallel to each other and further comprising axially aligned pivot means for pivotally connecting said planar members to the undercarriage frame such that said planar members would bear against said undercarriage frame under loading of said blade, said pivot means defining a first pivot axis extending through both of said planar members;

means for moving and positioning the first mounting means in either rotational direction from its home position about said first pivot axis;

second mounting means rigidly connected to said first mounting means and pivotally connected to the scraper blade; and means for moving and positioning the scraper blade about a second pivot axis defined by the pivotal connection between the scraper blade and the second mounting means, said second pivot axis being substantially parallel to a plane perpendicular to the first pivot axis and, when said first mounting means is in its home position, being substantially perpendicular to the plane of the undercarriage frame, whereby pivotal movement of the first mounting means in either rotational direction from its home position causes the second pivot axis to be rotated in a plane substantially perpendicular to the first pivot axis in either direction from an orientation perpendicular to the plane of the undercarriage frame.

2. The scraper blade supporting and positioning assembly as recited in claim 1 wherein the undercarriage frame comprises a pair of elongated members extending parallel to the longitudinal axis of the vehicle and wherein the pair of rigid, planar members comprises a pair of substantially rectangular plates, each plate being substantially perpendicular to said first pivot axis and pivotally connectable to one of said pair of elongated members, one edge of each plate being rigidly connected to the second mounting means.

3. The scraper blade supporting and positioning assembly as recited in claim 1 wherein the means for moving and positioning the first mounting means about the first pivot axis and the means for moving and positioning the scraper blade about the second pivot axis comprises hydraulically actuated means.

4. The scraper blade supporting and positioning assembly as recited in claim 3 wherein the hydraulically actuated means for moving and positioning the first mounting means comprises a hydraulic cylinder with one end attachable to the undercarriage frame and the other end attached to the first mounting means.

5. The scraper blade supporting and positioning assembly as recited in claim 3 wherein the hydraulically actuated means for moving and positioning the scraper blade about the second pivot axis comprises a hydraulic cylinder with one end connected to the scraper blade and the other end connected to the second mounting means.

6. The scraper blade supporting and positioning assembly as recited in claim 1 wherein the second mounting means comprises:

a pivot assembly rigidly connected to the scraper blade approximately midway between its ends; and means for pivotally mounting the pivot assembly, whereby the second pivot axis is defined as passing through the pivot assembly, and for connecting the pivot assembly to the first mounting means.

7. The scraper blade supporting and positioning assembly as recited in claim 6 wherein the means for pivotally mounting the pivot assembly and for connecting it to the first mounting means comprises a planar, subtantially circular member having said pivot assembly pivotally connected thereto such that the second pivot axis passes substantially through the center of the circular member and is substantially perpendicular to the circular member, said circular member further being rigidly connected to the first mounting means.

8. The scraper blade supporting and positioning assembly as recited in claim 7 wherein the second mounting means further comprises clip means connected to the scraper blade at points substantially equally displaced from the pivot assembly, said clip means slidably engaging the periphery of the circular member when the scraper blade pivots about the second pivot axis.

9. The scraper blade supporting and positioning assembly as recited in claim 8 wherein the means for moving and positioning the scraper blade about the second pivot axis comprises a hydraulic cylinder with one end connected to the circular member and the other end connected to the scraper blade at a point displaced from the pivot assembly.

10. A scraper blade supporting and positioning assembly for mounting a scraper blade under a vehicle, said vehicle having an undercarriage frame and a longitudinal axis corresponding to the direction of travel of the vehicle, comprising:

a scraper blade;

a pair of rigid, planar members, each said planar member being pivotally connectable to the undercarriage frame, with the pivotal connections being axially aligned and extending through both of said planar members to define a first pivot axis, said pair of rigid, planar members when so connected to said frame having a home position which would correspond to the lower edge of the scraper blade being substantially parallel to the plane of the undercarriage frame regardless of the angle between said blade and said longitudinal axis;

a planar, substantially circular member rigidly affixed to each of the pair of rigid, planar members at a point displaced from said first pivot axis, the planar, circular member being disposed in spaced relationship to said first pivot axis and being substantially parallel thereto and, when said pair of rigid, planar members is in its home position, being substantially parallel to the plane of the undercarriage frame;

a pivot assembly rigidly connected to the scraper blade and pivotally connected to the circular member and defining a second pivot axis which passes substantially through the center of the circular member and is oriented substantially perpendicular to the plane of the circular member, said second pivot axis further being substantially perpendicular to the lane of the undercarriage frame when said pair of rigid, planar members is in its home position and being rotatable in either direction from said perpendicular position upon pivoting of said rigid, planar members in either direction from said home position;

hydraulically actuated means connectable to the undercarriage frame and to at least one of the pair of rigid, planar members for moving and positioning the pair of rigid, planar members about the first pivot axis in either rotational direction from its home position; and hydraulically actuated means connected to the scraper blade for moving and positioning the scraper blade about the second pivot axis.

* * * * *